US008325124B2

(12) United States Patent
Fanchiang et al.

(10) Patent No.: US 8,325,124 B2
(45) Date of Patent: Dec. 4, 2012

(54) DISPLAY PANELS WITH COMMON VOLTAGE CONTROL UNITS

(75) Inventors: Kuo-Hao Fanchiang, Hsinchu (TW); Kung-Yi Chan, Hsinchu (TW); Huan-Hsin Li, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 383 days.

(21) Appl. No.: 12/612,855

(22) Filed: Nov. 5, 2009

(65) Prior Publication Data

US 2010/0321365 A1 Dec. 23, 2010

(30) Foreign Application Priority Data

Jun. 18, 2009 (TW) ..... 98120383 A

(51) Int. Cl.
*G09G 3/36* (2006.01)

(52) U.S. Cl. ..... 345/92; 345/204

(58) Field of Classification Search ..... 345/208–215, 345/48–54, 76–79, 94–100, 90, 204
See application file for complete search history.

(56) References Cited

U.S. PATENT DOCUMENTS

| | | | | |
|---|---|---|---|---|
| 5,854,616 | A * | 12/1998 | Ota et al. | 345/100 |
| 7,187,421 | B2 | 3/2007 | Tsunashima et al. | |
| 2003/0146895 | A1 * | 8/2003 | Chung | 345/97 |
| 2005/0088392 | A1 * | 4/2005 | Kim et al. | 345/94 |
| 2006/0284811 | A1 * | 12/2006 | Huang | 345/92 |
| 2007/0001957 | A1 * | 1/2007 | Moon et al. | 345/92 |
| 2009/0146977 | A1 * | 6/2009 | Chan et al. | 345/204 |

* cited by examiner

*Primary Examiner* — Alexander S Beck
*Assistant Examiner* — Charles Zheng
(74) *Attorney, Agent, or Firm* — McClure, Qualey & Rodack, LLP

(57) ABSTRACT

A display panel is provided and includes a display unit and a control unit. The display unit is coupled to a data line and a first scan line. In the display unit, a liquid crystal capacitor is coupled between a pixel electrode and a first common line, and a storage capacitor is coupled between the pixel electrode and a second common line. The control unit receives first and second common voltages and is controlled by first and second control voltage signals and first and second scan signals which are respectively on the first scan line and a second scan line and driven sequentially. The control unit changes the voltage level of the second common line by a two-step manner according to the first and second common voltages. Through feed-through effect of the storage capacitor, the voltage level of the pixel electrode is changed to a desired level.

12 Claims, 3 Drawing Sheets

DISPLAY PANELS WITH COMMON VOLTAGE CONTROL UNITS

CROSS REFERENCE TO RELATED APPLICATIONS

This application claims the benefit of Taiwan application Serial No. 98120383 filed Jun. 18, 2009, the subject matter of which is incorporated herein by reference.

BACKGROUND OF THE INVENTION

1. Field of the Invention

The invention relates to display panels, and more particularly to a display panel driven by a line inversion driving mode.

2. Description of the Related Art

Positive and negative video signals sorted by their relationships with common electrode voltage VCOM are provided to display arrays within liquid crystal display devices for display thereof. Continuous bias of single-polarity video signals shortens the operating life span of liquid crystal molecules of the display arrays. To avoid this, dot inversion, line inversion, and frame inversion driving modes have been developed for liquid crystal display devices. Particularly, the line inversion driving mode is generally used for liquid crystal display devices.

In conventional liquid crystal display devices with a line inversion driving mode, common lines coupled to display arrays provide an alternating current (AC) common voltage. However, the AC common voltage consumes more power. Thus, common lines providing direct current (DC) common voltage have been developed. However, in liquid crystal display devices using DC common voltage, large video signal amplitude is desired. Thus, the liquid crystal display devices have to operate with high supply voltages. Moreover, due to the feed-through effect generated by parasitical capacitors of switch transistors of display pixels, video signals with alternating polarities change voltage levels of pixel electrodes, so that desired voltage levels of the pixel electrodes are unstable.

Thus, it is desired to provide a display panel driven by a line inversion driving mode with low power consumption, wherein pixel electrodes in the display panel can reach desired voltage levels.

BRIEF SUMMARY OF THE INVENTION

An exemplary embodiment of a display panel comprises a display unit and a control unit. The display unit is coupled to a data line and a first scan line. The display unit comprises a liquid crystal capacitor and a first storage capacitor. The liquid crystal capacitor is coupled between a pixel electrode and a first common line. The first storage capacitor is coupled between the pixel electrode and a second common line. The control unit is coupled to the second common line and comprises first, second, third, and fourth transistors and a second storage capacitor. The first transistor has a control terminal coupled to the first scan line, an input terminal receiving a first common voltage, and an output terminal coupled to the second common line. The second transistor has a control terminal receiving a first control voltage signal, an input terminal receiving the first common voltage, and an output terminal coupled to a first node. The third transistor has a control terminal coupled to a second scan line, an input terminal receiving a second common voltage, and an output terminal coupled to the second common line. The fourth transistor has a control terminal receiving a second control voltage signal, an input terminal receiving the second common voltage, and an output terminal coupled to the first node. The second storage capacitor is coupled between the first node and the second common line.

Another exemplary embodiment of a display panel comprises a plurality of data lines, a plurality of scan lines, a first common line, a plurality of second common lines, a plurality of display units, and a plurality of control units. The display units are coupled to the first common line and disposed by a plurality of rows and columns. The display units disposed on the same row are coupled to the same scan line and the same second common line. The control units are respectively coupled to the second common lines. Each of the control units is coupled to the display units disposed on one row through the corresponding second common line. Each of the control units comprises first, second, third, and fourth transistors and a first storage capacitor. The first transistor has a control terminal coupled to the corresponding scan line, an input terminal receiving a first common voltage, and an output terminal coupled to the corresponding second common line. The second transistor has a control terminal receiving a first control voltage signal, an input terminal receiving the first common voltage, and an output terminal coupled to a first node. The third transistor has a control terminal, an input terminal receiving a second common voltage, and an output terminal coupled to the corresponding second common line. The control terminal of the third transistor is coupled to the scan line which the display units disposed on the next row are coupled to. The fourth transistor has a control terminal receiving a second control voltage signal, an input terminal receiving the second common voltage, and an output terminal coupled to the first node. The first storage capacitor is coupled between the first node and the corresponding second common line.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
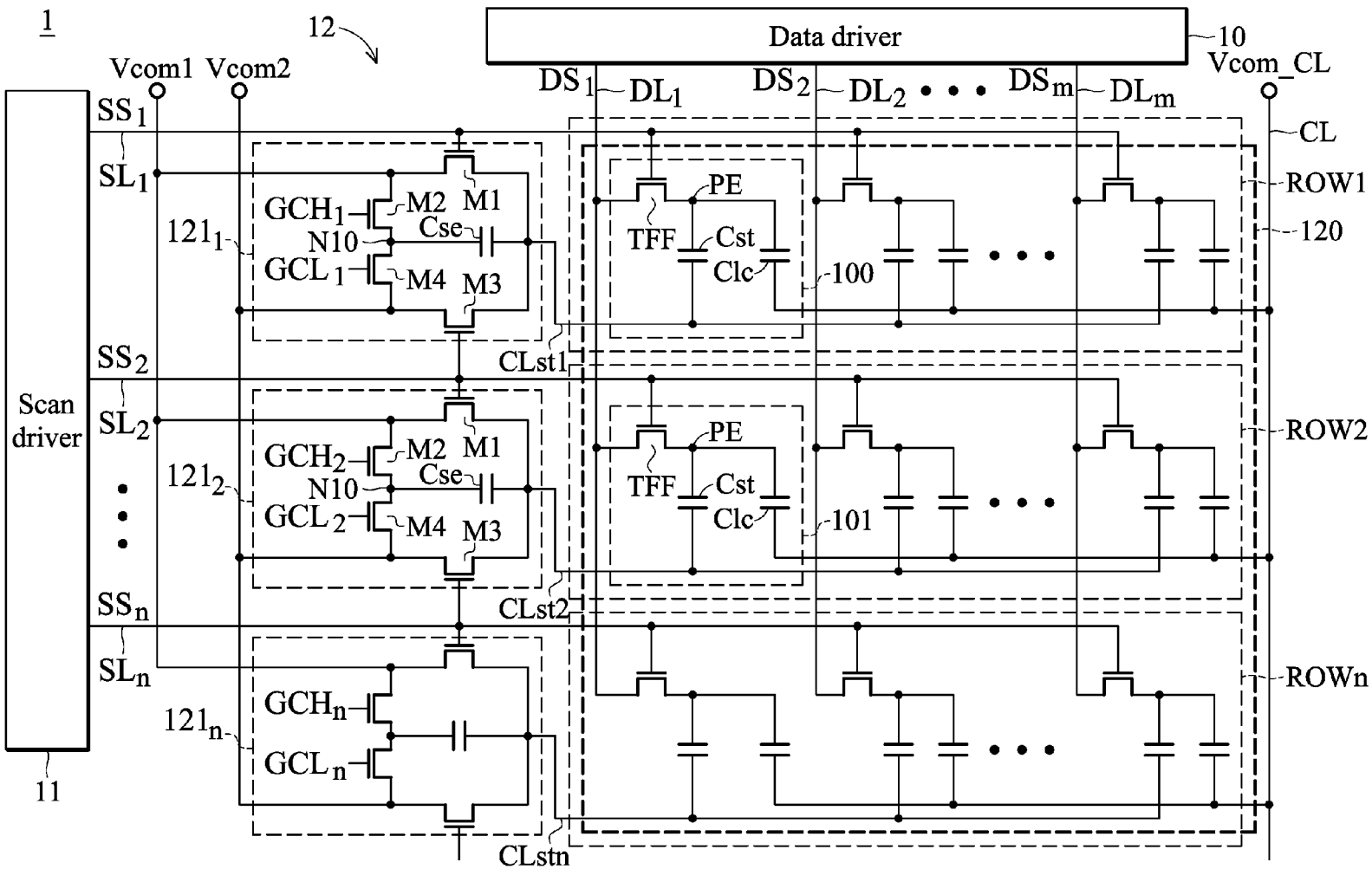
FIG. 1 shows an exemplary embodiment of a display device.

Display devices are provided. In an exemplary embodiment of a display device in FIG. 1, a display device 1 comprises a data driver 10, a scan driver 11, and a display panel 12. The display panel 12 comprises a plurality of data lines $DL_1$-$DL_m$, a plurality of scan lines $SL_1$-$SL_n$, a first common line CL, a plurality of second common lines $CLst_1$-$CLst_n$, a display array 120, and a plurality of control unit $\mathbf{121}_1$-$\mathbf{121}_n$. As shown in FIG. 1, the data lines $DL_1$-$DL_m$ are interlaced with the scan lines $SL_1$-$SL_n$. The data driver 12 provides data signals $DS_1$-$DS_m$ to the display array 120 respectively through the data lines $DL_1$-$DL_m$, and the scan driver 11 provides scan signals $SS_1$-$SS_n$ to the display array 120 respectively through the scan lines $SL_1$-$SL_n$. In this embodiment, the display device 1 drives the display pane 12 by a line inversion driving mode.

The display array 120 comprises a plurality of display units. The display units are disposed on a plurality of rows and columns, and each display unit corresponds to the interlaced data line and scan line. For example, a display unit 100 corresponds to the interlaced data line $DL_1$ and scan line $SL_1$. In the following, the display unit 100 is given as an example for describing the structure of the display units. The display unit 100 comprises a switch transistor TFT, a storage capacitor Cst, and a liquid crystal capacitor Clc. A control terminal (gate) of the switch transistor TFT is coupled to the corresponding scan line $SL_1$, an input terminal (drain) thereof is coupled to the corresponding data line $DL_1$, and an output terminal (source) thereof is coupled to a pixel electrode PE. The liquid crystal capacitor Clc of the display unit 100 is formed between the pixel electrode PE and the first common line CL, and the storage capacitor Cst is coupled between the pixel electrode PE and the corresponding second common line $CLst_1$.

As shown in FIG. 1, in the embodiment, the liquid crystal capacitors Clc of all the display units in the display array 120 are coupled to the first common line CL, and the first common line CL provides a common voltage Vcom_CL to the display units. Moreover, the storage capacitors of the display units disposed on the same row are coupled to the same second common line. For example, the storage capacitors of all the display units disposed on the same row ROW1 as the display unit 100 are coupled to the second common line $CLst_1$, and the storage capacitors of all the display units disposed on the same row ROW2 as the display unit 100 are coupled to the second common line $CLst_2$.

The control units $\mathbf{121}_1$-$\mathbf{121}_n$ are respectively coupled to the second common lines $CLst_1$-$CLst_n$. Each of the control units $\mathbf{121}_1$-$\mathbf{121}_n$ is coupled the display units disposed on the corresponding row through the corresponding second common line. For example, the control units $\mathbf{121}_1$ is coupled the display units disposed on the row ROW1 through the second common line $CLst_1$. In the following, the control unit $\mathbf{121}_1$ is given as an example for describing the structure of the control units. Referring to FIG. 1, the control unit $\mathbf{121}_1$ comprises transistors M1-M4 and a storage capacitor Cse. A control terminal (gate) of the transistor M1 is coupled to the scan line $SL_1$, an input terminal (drain) thereof receives a common voltage Vcom1, and an output terminal (source) thereof is coupled to the corresponding second common line $CLst_1$. A control terminal of the transistor M2 receives a control voltage signal $GCH_1$, an input terminal thereof receives the common voltage Vcom1, and an output terminal thereof is coupled to a node N10. A control terminal of the transistor M3 is coupled to the scan line $SL_2$ which the display units disposed on the next row ROW2 are coupled to, an input terminal thereof receives a common voltage Vcom2, and an output terminal thereof is coupled to the corresponding second common line $CLst_1$. A control terminal of the transistor M4 receives a control voltage signal $GCL_1$, an input terminal thereof receives the common voltage Vcom2, and an output terminal thereof is coupled to the node N10. The storage capacitor Cse is coupled between the node N10 and the corresponding second common line $CLst_1$. In the embodiment, the common voltages Vcom1 and Vcom2 are DC voltages, and the level of the common voltage Vcom1 is higher than the level of the common voltage Vcom2. The control voltage signals $GCH_1$ and $GCL_1$ are out of phase.

Referring to FIG. 1, the transistors M2 of the control units $\mathbf{121}_1$-$\mathbf{121}_n$ respectively receive the control voltage signals $GCH_1$-$GCH_n$, and the transistors M4 of the control units $\mathbf{121}_1$-$\mathbf{121}_n$ respectively receive the control voltage signals $GCL_1$-$GCL_n$.

Figure 2:
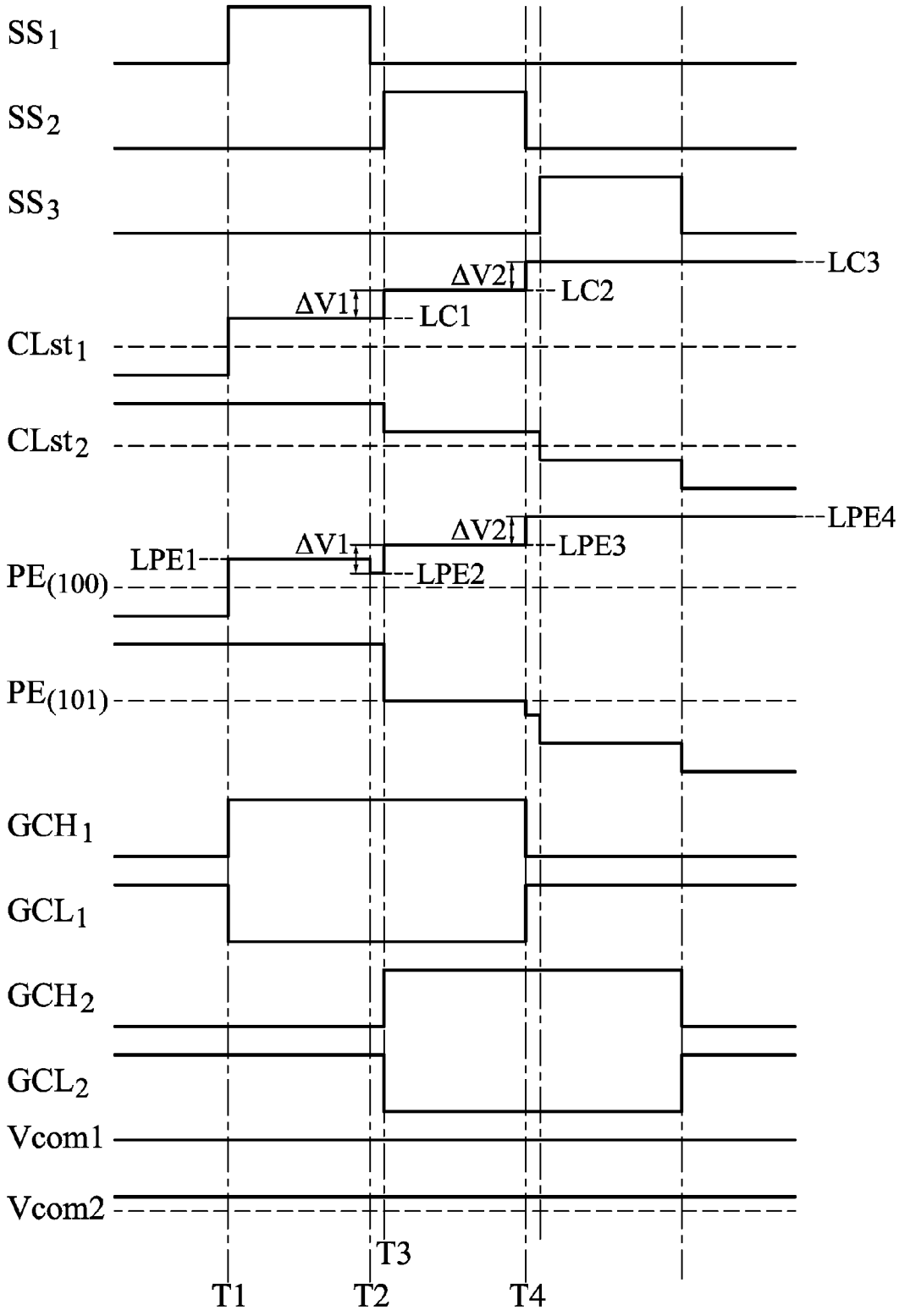
FIG. 2 is a timing chart of the signals of the display device of FIG. 1 in one frame period.

FIG. 2 is a timing chart of the signals of the display device 1 in one frame period. Referring to FIG. 2, the scan lines $SL_1$-$SL_n$ are sequentially driven, and the durations when the scan lines $SL_1$-$SL_n$ (that is when the scan signals $SS_1$-$SS_n$ are at a high voltage level) are driven do not overlap. The operation of the display device 1 will be described by the display unit 100 disposed on the row ROW1 as shown in FIG. 2. Referring to FIG. 2, at a time point T1, the scan line $SL_1$ is initially driven (that is the scan signal $SS_1$ rises to a high voltage level), and the switch transistor TFT within the display unit 100 disposed on the row ROW1 is turned on, so that the voltage level of the pixel electrode PE rises to a level LPE1 according to the data signal $DS_1$ with a positive polarity on the data line $DL_1$. The transistor M1 of the control unit $\mathbf{121}_1$ is also turned on according to the scan signal $SS_1$ of the high voltage level. Thus, the voltage level of the second common line $CLst_1$ rises to a level LC1 according to the common voltage Vcom1. At the time point T1, the control voltage signal $GCH_1$ is asserted (that is the control voltage signal $GCH_1$ is at a high voltage level) to turn on the transistor M2, and the control voltage signal $GCL_1$ is asserted (that is the control voltage signal $GCL_1$ is at a low voltage level) to turn off the transistor M4. Thus, the storage capacitor Cse is charged according to the common voltage Vcom1.

At a time point T2, the scan line $SL_1$ initially stops from being driven, that is the scan signal $SS_1$ lowers to a low voltage level. At this time, by feed-through effect of the parasitical capacitor Cgs between the gate and source of the switch transistor TFT, the pixel electrode PE falls to a level LPE2 with the variation of the voltage level of the scan signal $SS_1$.

At a time point T3, the scan line $SL_2$ is initially driven, that is the scan signal $SS_2$ rises to a high voltage level. The transistor M3 is turned on according to the scan signal $SS_2$ of the high voltage level. At this time, the voltage level of the second common line $CLst_1$ rises to a level LC2 according to the common voltage Vcom2. The voltage difference ΔV1 between the levels LC1 and LC2 is represented as:

$$\Delta V1 = \frac{Cse}{Cse + Ctotal} \times |Vcom2 - Vcom1|$$

wherein, Ctotal represents the total capacitance of the storage capacitors Cst of all the display units disposed on the row ROW1.

Since the voltage level of the second common line $CLst_1$ rises, the voltage level of the pixel electrode PE also rises to a level LPE3 from the level LPE2 by ΔV1 according to feed-through effect of the storage capacitor Cst.

At a time point T4, the scan line $SL_2$ initially stops from being driven, that is the scan signal $SS_2$ lowers to a low voltage level. At this time, the control voltage signal $GCH_1$ is not asserted (that is the control voltage signal $GCH_1$ lowers to a low voltage level) to turn off the transistor M2, and the control voltage signal $GCL_1$ is not asserted (that is the control voltage signal $GCL_1$ rises to a high voltage level) to turn on the transistor M4. The voltage level at the node N10 rises according to the common voltage Vcom2. By feed-through effect of the storage capacitor Cse, the voltage level of the second common line $CLst_1$ rises to a level LC3 according to the variation of the voltage level at the node N10. The voltage difference ΔV2 between the levels LC2 and LC3 is represented as:

$$\Delta V2 = \frac{Cse}{Cse + Ctotal} \times |Vcom2 - Vcom1|$$

Since the voltage level of the second common line $CLst_1$ rises, the voltage level of the pixel electrode PE also rises to a level LPE4 from the level LPE3 by ΔV2 according to the feed-through effect of the storage capacitor Cst. After the time point T4, the voltage level of the pixel electrode remains at the level LPE4 until the next frame period.

The total voltage difference of the voltage level of the second common line $CLst_1$ from the level LC1 to the level LC3 is represented as:

$$\Delta Vsum = DS_1 + \frac{-(Cgs \times \Delta Vg) \pm [Cst \times (\Delta V1 + \Delta V2)]}{Ctotal}$$

wherein, ΔVg represents the voltage difference between the high voltage level and the low voltage level of the scan signal $SS_1$.

In the embodiment, the control voltage signals $GCH_1$ and $GCL_1$ received by the control unit $\mathbf{121}_1$ are continuously asserted in durations when the corresponding scan line $SL_1$ and the next scan line $SL_2$ are driven (from the time point T1 to the time point T4). The common voltages Vcom1 and Vcom2 are alternatively switched to charge the storage capacitor Cse according to the control voltage signals $GCH_1$ and $GCL_1$ and further charge the voltage level of the second common line $CLst_1$.

According to the above description, compared with a display device with an AC common voltage, the display device 1 with the DC common voltages Vcom1 and Vcom2 has lower power consumption. Moreover, by the variation of the voltage level of the second common line $CLst_1$ and the feed-through effect of the storage capacitor Cst, the voltage level of the pixel electrode PE rises to the desired level LPE4 by a two-step manner and remains at the desired level LPE4. Thus, the data signal $DS_1$ does not require a large amplitude, and the display device 1 can operate by low supply voltage.

Referring to FIG. 2 again, at the time point T3, the scan line $SL_2$ is driven, and the control voltage signals $GCH_2$ and $GCL_2$ are asserted. The second common line $CLst_2$ corresponding to the display units disposed on the row ROW2 first starts to perform the two-step manner as described previously to reach a desired voltage level. Note that since the display device 1 is driven by a line inversion mode, the polarity of the pixel electrode PE of the display unit 100 is opposite to that of the display unit 100. Thus, the pixel electrode PE of the display unit 101 and the second common line $CLst_2$ fall to a desired low voltage level by the two-step manner. Briefly, the pixel electrode of the display units disposed on the odd rows and the corresponding second common line rise to a desired high voltage level by the two-step manner, while the pixel electrode of the display units disposed on the even rows and the corresponding second common line fall to a desired low voltage level by the two-step manner.

Figure 3:
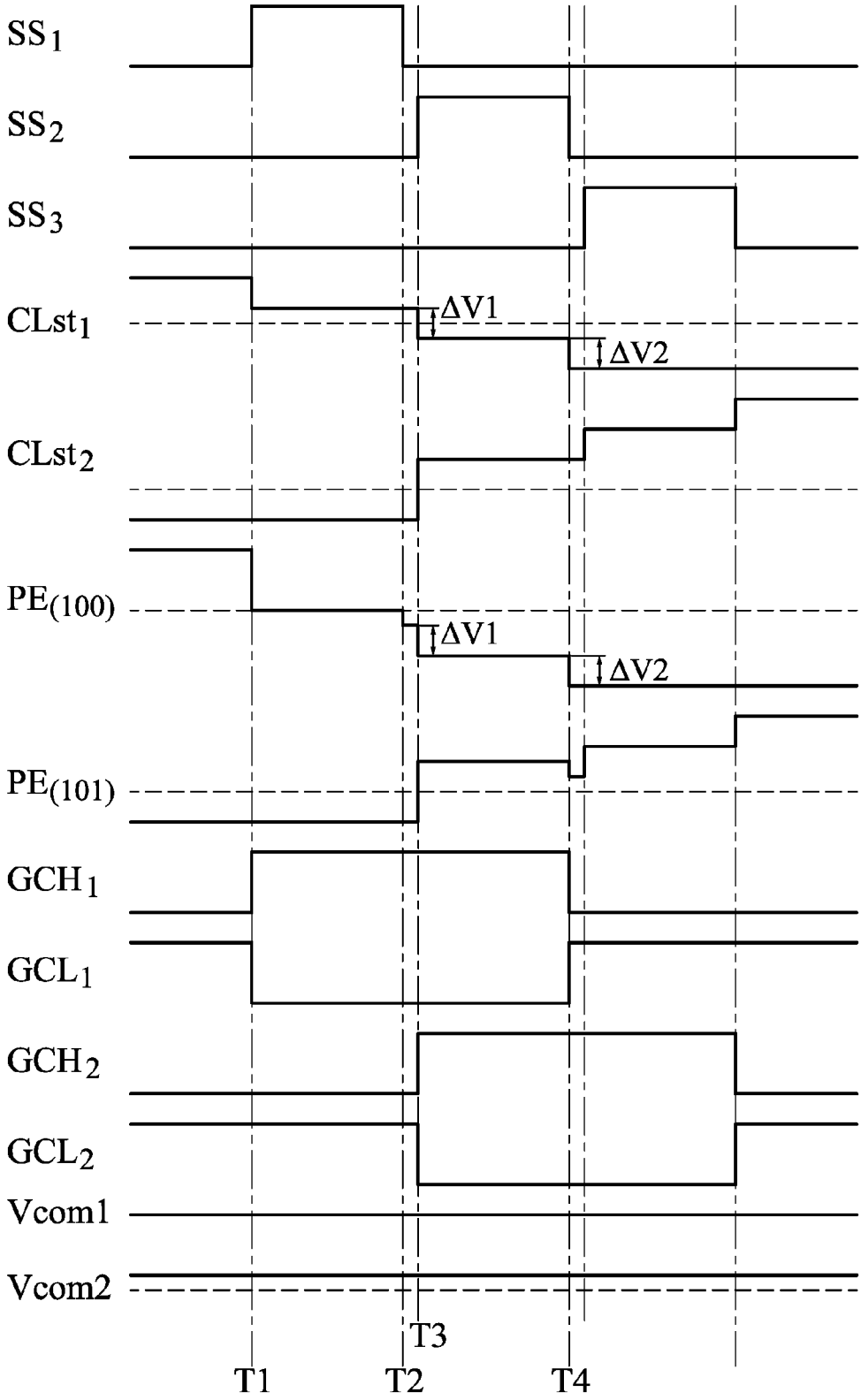
FIG. 3 is a timing chart of the signals of the display device in the frame period next to the frame period of FIG. 2.

FIG. 3 is a timing chart of the signals of the display device 1 in the frame period next to the frame period shown in FIG. 2. In the next frame period, the polarities of the pixel electrodes PE of the display units 100 and 101 are changed. The pixel electrode PE of the display unit 100 and the second common line $CLst_1$ fall to a desired low voltage level by the two-step manner, while the pixel electrode PE of the display unit 101 and the second common line $CLst_2$ rise to a desired high voltage level by the two-step manner.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display panel comprising:

a display unit coupled to a data line and a first scan line, wherein the display unit comprises:

a liquid crystal capacitor coupled between a pixel electrode and a first common line; and a first storage capacitor coupled between the pixel electrode and a second common line; and a control unit coupled to the second common line and comprising:

a first transistor having a control terminal coupled to the first scan line, an input terminal receiving a first common voltage, and an output terminal coupled to the second common line;

a second transistor having a control terminal receiving a first control voltage signal, an input terminal receiving the first common voltage, and an output terminal coupled to a first node;

a third transistor having a control terminal coupled to a second scan line, an input terminal receiving a second common voltage, and an output terminal coupled to the second common line;

a fourth transistor having a control terminal receiving a second control voltage signal, an input terminal receiving the second common voltage, and an output terminal coupled to the first node; and a second storage capacitor coupled between the first node and the second common line, wherein the first scan line is asserted from a first time point to a second time point;

wherein the second scan line is asserted from a third time point to a fourth time point, and the third time point is between the second time point and the fourth time point; and wherein the first control voltage signal and the second control voltage signal are continuously asserted from the first time point to the fourth time point.

2. The display panel as claimed in claim 1, wherein the first control voltage signal and the second control voltage signal are out of phase.

3. The display panel as claimed in claim 1, wherein the first control voltage signal is asserted to turn on the second transistor, and the second control voltage signal is asserted to turn off the fourth transistor.

4. The display panel as claimed in claim 1, wherein the first common voltage and the second common voltage are DC voltages.

5. The display panel as claimed in claim 4, wherein a level of the first common voltage is higher than a level of the second common voltage.

6. The display panel as claimed in claim 1, wherein the display unit further comprises a switch transistor having a control terminal coupled to the first scan line, an input terminal coupled to the data line, and an output terminal coupled to the pixel electrode.

7. A display panel comprising:

a plurality of data lines;

a plurality of scan lines;

a first common line;

a plurality of second common lines;

a plurality of display units coupled to the first common line and disposed by a plurality of rows and columns, wherein the display units disposed on the same row are coupled to the same scan line and the same second common line; and a plurality of control units respectively coupled to the second common lines, wherein each of the control units is coupled to the display units disposed on one row through the corresponding second common line, and each of the control units comprises:

a first transistor having a control terminal coupled to the corresponding scan line, an input terminal receiving a first common voltage, and an output terminal coupled to the corresponding second common line;

a second transistor having a control terminal receiving a first control voltage signal, an input terminal receiving the first common voltage, and an output terminal coupled to a first node;

a third transistor having a control terminal, an input terminal receiving a second common voltage, and an output terminal coupled to the corresponding second common line, wherein the control terminal of the third transistor is coupled to the scan line which the display units disposed on the next row are coupled to;

a fourth transistor having a control terminal receiving a second control voltage signal, an input terminal receiving the second common voltage, and an output terminal coupled to the first node; and a first storage capacitor coupled between the first node and the corresponding second common line;

wherein the scan lines are sequentially driven, and durations when the scan lines are driven do not overlap; and wherein for each of the control units, from a time point when the corresponding scan line is initially driven to a time point when the next scan line initially stops from being driven, the first control voltage signal and the second control voltage signal are continuously asserted.

8. The display panel as claimed in claim 7, wherein for each of the control units, the first control voltage signal and the second control voltage signal are out of phase.

9. The display panel as claimed in claim 8, wherein for each of the control units, the first control voltage signal is asserted to turn on the second transistor, and the second control voltage signal is asserted to turn off the fourth transistor.

10. The display panel as claimed in claim 7, wherein the first common voltage and the second common voltage are DC voltages.

11. The display panel as claimed in claim 10, wherein a level of the first common voltage is higher than a level of the second common voltage.

12. The display panel as claimed in claim 7, wherein each of the display units comprises:

a liquid crystal capacitor coupled to a pixel electrode and the first common line;

a second storage capacitor coupled between the pixel electrode and the corresponding second common line; and a switch transistor having a control terminal coupled to the corresponding scan line, an input terminal coupled to the corresponding data line, and an output terminal coupled to the pixel electrode.

* * * * *